US012364302B2

(12) United States Patent
O'Connell et al.

(10) Patent No.: US 12,364,302 B2
(45) **Date of Patent: *Jul. 22, 2025**

(54) RAIL FOR MOUNTING ACCESSORIES TO A HELMET

(71) Applicant: Gentex Corporation, Simpson, PA (US)

(72) Inventors: Jason W. O'Connell, Raynham, MA (US); Duco W. Noordzij, Roslindale, MA (US)

(73) Assignee: Gentex Corporation, Simpson, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/530,785

(22) Filed: Dec. 6, 2023

(65) Prior Publication Data

US 2024/0108092 A1 Apr. 4, 2024

Related U.S. Application Data

(63) Continuation of application No. 18/056,357, filed on Nov. 17, 2022, now Pat. No. 11,889,879, which is a (Continued)

(51) Int. Cl.
*A42B 3/04* (2006.01)

(52) U.S. Cl.
CPC ..... *A42B 3/0406* (2013.01)

(58) Field of Classification Search
CPC ..... A42B 3/04; A42B 3/0406; A42B 3/225; A42B 3/228
See application file for complete search history.

(56) References Cited

U.S. PATENT DOCUMENTS 3,839,738 A 10/1974 Coslett
4,442,551 A 4/1984 Hellberg
(Continued)

FOREIGN PATENT DOCUMENTS

EM 002961797-0002 5/2016
EP 2473075 A2 7/2012
(Continued)

OTHER PUBLICATIONS

International Search Report dated Jun. 1, 2018, for International Patent Application No. PCT/US2018/022221, 3 pages.
(Continued)

*Primary Examiner* — Tajash D Patel
(74) *Attorney, Agent, or Firm* — Morgan, Lewis & Bockius LLP

(57) ABSTRACT

A mounting rail assembly comprises a rail configured to be coupled to a helmet. The rail may include a rear surface and a front surface with a mounting groove extending along a length of the front surface. The mounting groove may be open outwardly from a front surface of the rail and be configured to couple to a first accessory device at two or more positions along the length of the rail. A recess may be proximate an edge of the mounting rail assembly. The recess may be open generally perpendicular to the mounting groove and configured to receive a second accessory device. At least a portion of the recess may be positioned between the mounting groove and the rear surface of the rail.

16 Claims, 12 Drawing Sheets

Related U.S. Application Data continuation of application No. 16/942,083, filed on Jul. 29, 2020, now Pat. No. 11,528,951, which is a continuation of application No. 16/493,587, filed as application No. PCT/US2018/022221 on Mar. 13, 2018, now Pat. No. 10,765,165.

(60) Provisional application No. 62/470,630, filed on Mar. 13, 2017.

(56) References Cited

U.S. PATENT DOCUMENTS

| | | | | |
|---|---|---|---|---|
| 5,752,276 | A | 5/1998 | Baudou et al. | |
| 6,472,776 | B1 | 10/2002 | Soto et al. | |
| 7,849,517 | B2 | 12/2010 | Rogers et al. | |
| D766,521 | S | 9/2016 | Hanudel | |
| 10,448,693 | B2 | 10/2019 | Noordzij et al. | |
| 10,765,165 | B2 | 9/2020 | O'Connell et al. | |
| 11,528,951 | B2 | 12/2022 | O'Connell et al. | |
| 11,889,879 | B2 * | 2/2024 | O'Connell | A62B 18/084 |
| 2009/0083890 | A1 | 4/2009 | Dempsey | |
| 2009/0307826 | A1 | 12/2009 | Rogers et al. | |
| 2011/0239354 | A1 | 10/2011 | Celona | |
| 2013/0191967 | A1 | 8/2013 | Harris | |
| 2014/0075654 | A1 | 3/2014 | McGinn et al. | |
| 2015/0135417 | A1 | 5/2015 | Lebel et al. | |
| 2015/0189939 | A1 | 7/2015 | Roberts | |
| 2016/0327373 | A1 | 11/2016 | Noordzij et al. | |
| 2018/0192726 | A1 | 7/2018 | Chen | |
| 2018/0192727 | A1 | 7/2018 | Chen | |
| 2019/0320753 | A1 | 10/2019 | Le et al. | |

FOREIGN PATENT DOCUMENTS

| | | | | |
|---|---|---|---|---|
| JP | 2014-135980 | A | 7/2014 | |
| WO | 2010037214 | A1 | 4/2010 | |
| WO | 2011028966 | A2 | 3/2011 | |
| WO | 2013006204 | A1 | 1/2013 | |
| WO | 2013192070 | A1 | 12/2013 | |
| WO | WO-2015108854 | A1 * | 7/2015 | A42B 1/24 |
| WO | 2015156864 | A2 | 10/2015 | |
| WO | 2016033670 | A2 | 3/2016 | |
| WO | 2017062368 | | 4/2017 | |
| WO | WO-2020237189 | A1 * | 11/2020 | A42B 3/04 |

OTHER PUBLICATIONS

Written Opinion dated Jun. 1, 2018, for International Patent Application No. PCT/US2018/022221, 3 pages.

"ARC Helmet Rail MMICH/ACH/PASGT Helmet Tactical Rail Tan" (Hiairsoft.Com); archive dated Feb. 28, 2014, retrieved from https://web.archive.org/20140228061521/http://www.hiairsoft.com/arc-helmet-rail-michachpasgt-helmet-tactical-rail-tan-p-1031.html, retrieved on May 12, 2018; all pages.

"Ops-Core Launches FAST SF Helmet Line" (Soldiersystems.net); archive dated Sep. 15, 2017, retrieved from https://web.archive.org/web/20170915044420/http://soldiersystems.net/2017/09/12/dsei-17-ops-core-launches-fast-sf-helmet-line/, retrieved on May 16, 2018; all pages.

Examination Report No. 1 for Australian Patent Application No. 2018236209 dated Apr. 21, 2020, 4 pages.

ARC Helmet Rail MICH/ACH/PASGT Helmet Tactical Rail TAN [retrieved from Internet on Apr. 17, 2020] <URL: https://web.archive.org/web/2014/-02-28061521/http://www.hiairsoft.com/arc-helmet-rail-michachpasgt-helmet-tactical-rail-tan-p-1031.html> published on Feb. 28, 2014.

Extended European Search Report for European Patent Application No. 187666676.3 dated Nov. 17, 2020, 8 pages.

Extended European Search Report for corresponding European Patent Application No. 22191349.4 dated May 3, 2023, 9 pages.

Translation of Opposition for corresponding European Patent Application No. 3 595 472 B1 dated May 23, 2023, 64 pages.

Ops-Core, Launches FAST SF Helmet LINE (soldiersystems.net), published on Sep. 15, 2017.

* cited by examiner

RAIL FOR MOUNTING ACCESSORIES TO A HELMET

CROSS-REFERENCE TO RELATED APPLICATIONS

This application is a continuation of U.S. patent application Ser. No. 18/056,357 filed Nov. 17, 2022, which is a continuation of U.S. patent application Ser. No. 16/942,083 filed Jul. 29, 2020, now U.S. Pat. No. 11,528,951, which is a continuation of U.S. patent application Ser. No. 16/493,587 filed Sep. 12, 2019, now U.S. Pat. No. 10,765,165 issued Sep. 8, 2020, which is a 371 of International Application No. PCT/US2018/022221 filed on Mar. 13, 2018, which claims the benefit of U.S. Provisional Patent Application No. 62/470,630 filed Mar. 13, 2017 entitled "Mounting Rail Base Plate", each of which is incorporated by reference herein in its entirety.

BACKGROUND OF THE INVENTION

The present invention generally relates to a connection system for a helmet and, more particularly, to a mounting rail assembly for connecting accessories to a helmet.

Helmets may be worn for protection in a variety of settings including recreational use such as rock climbing or used in industry such as by military, firefighter, construction, manufacturing, or police personnel. It is sometimes desirable to have an accessory mounted to the helmet such as a camera, face shield, light, battery, or mask. Traditional helmet systems do not offer many options for attaching an accessory to a helmet. Accessories attached with adhesive may become dislodged from the helmet. Accessories that are mounted with anchors such as screws may require holes to be drilled into the helmet which can detrimentally affect the structural integrity of the helmet. Thus, an improved way to couple accessories to a helmet is desired.

BRIEF SUMMARY OF THE INVENTION

In one embodiment, a mounting rail assembly may comprise a rail configured to be coupled to a helmet. The rail may include a rear surface and a front surface with a mounting groove extending along a length of the front surface. The mounting groove may be open outwardly from a front surface of the rail and configured to couple to a first accessory device at two or more positions along the length of the rail. A recess may be proximate an edge of the mounting rail assembly and the recess may be open generally perpendicular to the mounting groove and configured to receive a second accessory device. At least a portion of the recess may be positioned between the mounting groove and the rear surface of the rail.

In a further embodiment, the mounting rail assembly may include a shim configured to be positioned between the rail and the helmet. The shim may form forming at least a portion of the recess. The recess may be formed by an indent in a front surface of the shim and the rear surface of the rail. In a further embodiment, the mounting rail assembly may include a fastener having a first portion configured to be positioned at least partially within the recess and a second portion configured to be coupled to a second accessory device. The recess may include a protrusion and the fastener may include a plurality of prongs separated by a space. The protrusion may be configured to be positioned within the space when the plurality of prongs are within the recess. The rail may include at least one indent below the mounting groove. The fastener may include an attachment arm configured to engage the at least one indent to further couple the fastener to the mounting rail assembly when the fastener is positioned at least partially within the recess. The attachment arm may include at least one peg configured to engage the at least one indent when the attachment arm is in the engaged position.

In a further embodiment, the mounting rail assembly may include the second accessory device which may include one or more of a mandible shield, a communication system, a gas supply mask, and a chin strap. The recess may include a first recess and the mounting rail assembly may include a second recess proximate the edge of the mounting rail assembly, open generally in an opposite direction of the first recess, and configured to receive a third accessory device. In a further embodiment, the mounting rail assembly may include a third accessory device including one or more of a ballistic panel or applique, a visor, a goggle, a communication system, a retention system, a light, a camera, a helmet cover, a battery, a gas supply mask, a cable, and a cord. The shim may be configured to flex to conform to a shape of an exterior surface of the helmet. The shim may include an aperture configured to align with existing apertures in the rail. One of the shim and the rail may include at least two projections that extend into a corresponding feature on the other of the shim and the rail to align the rail with the shim. The shim may include a body with a plurality of openings extending through the body. The mounting rail assembly may be a unitary construct including the shim and the rail. The recess may include a sidewall and the mounting rail assembly may include a release selectively engageable by a user to disengage the fastener from the sidewall. The fastener may include a deflectable arm and the release may be configured to deflect the deflectable arm to disengage the fastener from the sidewall. The sidewall may include a ledge and the deflectable arm may include a rim configured to engage the ledge when the fastener may be within the recess. The fastener may include a brace configured to maintain the position of the fastener in the recess when the release may be moved relative to the shim.

In one embodiment, a mounting rail system may comprise a rail configured to be coupled to a helmet. The rail may include a mounting groove extending along a length of the rail, open outwardly from the helmet, and configured to couple to a first accessory device at two or more positions along the length of the rail. A recess may be proximate an edge of the mounting rail assembly, the recess opens generally perpendicular to the mounting groove, and configured to receive a second accessory device. A shim may be removably coupled to a rear surface of the rail. The shim may be positioned between the rail and the helmet when the rail is coupled to the helmet, the shim forming at least a portion of the recess.

In one embodiment, a shim may be configured to be removably coupled between a helmet and a rail having a mounting groove extending along a length of a front surface of the rail and configured to couple to a first accessory device at two or more positions along the length of the rail. The shim may have an outer perimeter generally shaped to match a footprint of the rail, and a recess open outwardly and configured to be closed off by the rail. The recess may be open upwardly to receive an accessory device when the shim is coupled between the rail and the helmet. The recess may include a first recess and the shim may further include a second recess open generally in an opposite direction of the first recess and configured to receive a second accessory device. In a further embodiment, the shim may include at least two alignment projections extending from a front surface of the shim configured to extend into a corresponding feature on the rail to align the rail with the shim. The shim may include a first portion including a first axis and a second portion including a second axis and the first axis is transverse to the second axis. The shim may include a release selectively engageable by a user and configured to disengage the accessory device from the recess.

BRIEF DESCRIPTION OF THE SEVERAL VIEWS OF THE DRAWINGS

The following detailed description of embodiments of the mounting rail assembly will be better understood when read in conjunction with the appended drawings of exemplary embodiments. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE INVENTION

Figure 1:
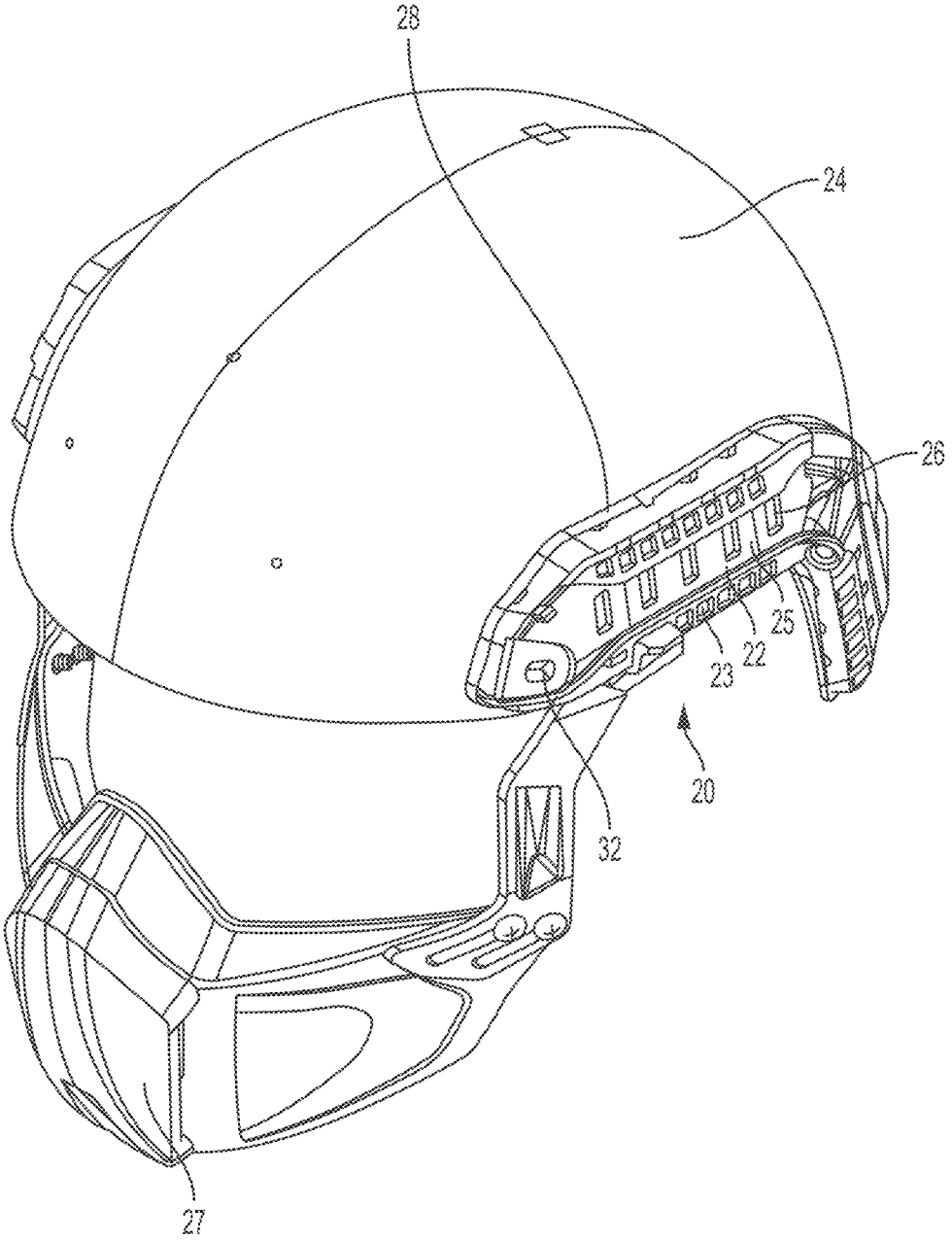
FIG. 1 is a front, side perspective view of a mounting rail assembly in accordance with an exemplary embodiment of the present invention coupled to a helmet and an accessory device.

Referring to the drawings in detail, wherein like reference numerals indicate like elements throughout, there is shown in FIGS. 1-10 a mounting rail assembly, generally designated 20, in accordance with an exemplary embodiment of the present invention. The mounting rail assembly 20 may include a rail 22 coupled to a helmet 24. The rail 22 may include one or more engagement features configured to selectively couple one or more devices to the helmet 24. As described in further detail below, the mounting rail assembly 20 may allow for one or more accessory devices to be coupled to an edge of the rail 22 or an edge of the mounting grail system 20 without blocking access to a mounting groove 29 extending along a front surface of the rail 22 for coupling one or more additional accessory devices to the rail 22. The one or more accessory devices coupled to the rail 22 may include, for example but are not limited to, a mandible shield, a ballistic panel or applique, a visor, a goggle, a communication system, a retention system including a chin strap, a light, a camera, a helmet cover, a battery, and/or a gas supply mask. In one embodiment, the accessory device is coupled to the rail such that the device is positioned below the rail. In another embodiment, the accessory device is coupled to the rail such that the device is above or adjacent the rail. The first engagement feature may be a track, mounting groove 29, indents 23, and/or openings 26 along an edge of the rail 22 configured to receive or couple to the corresponding engagement feature of the accessory device. The second engagement feature may be a recess 36 configured to receive a fastener, as explained in greater detail below. One rail contemplated for use with embodiments the present invention where the rail is retro fitted to include additional attachment features is described in U.S. Pat. No. 7,849,517, which is hereby incorporated by reference in its entirety, although other rails are also contemplated.

Figure 3:
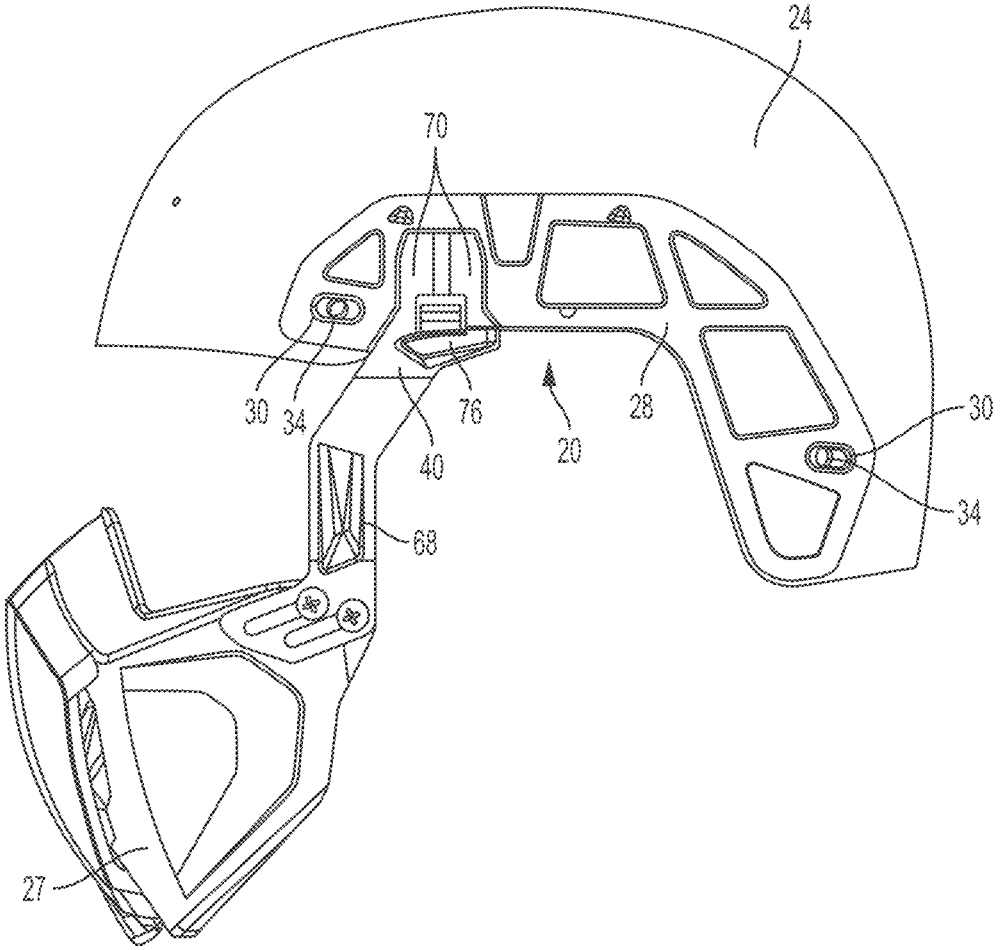
FIG. 3 is a left side elevational vide of the mounting rail assembly of FIG. 1 with the outer rail removed.
Figure 4:
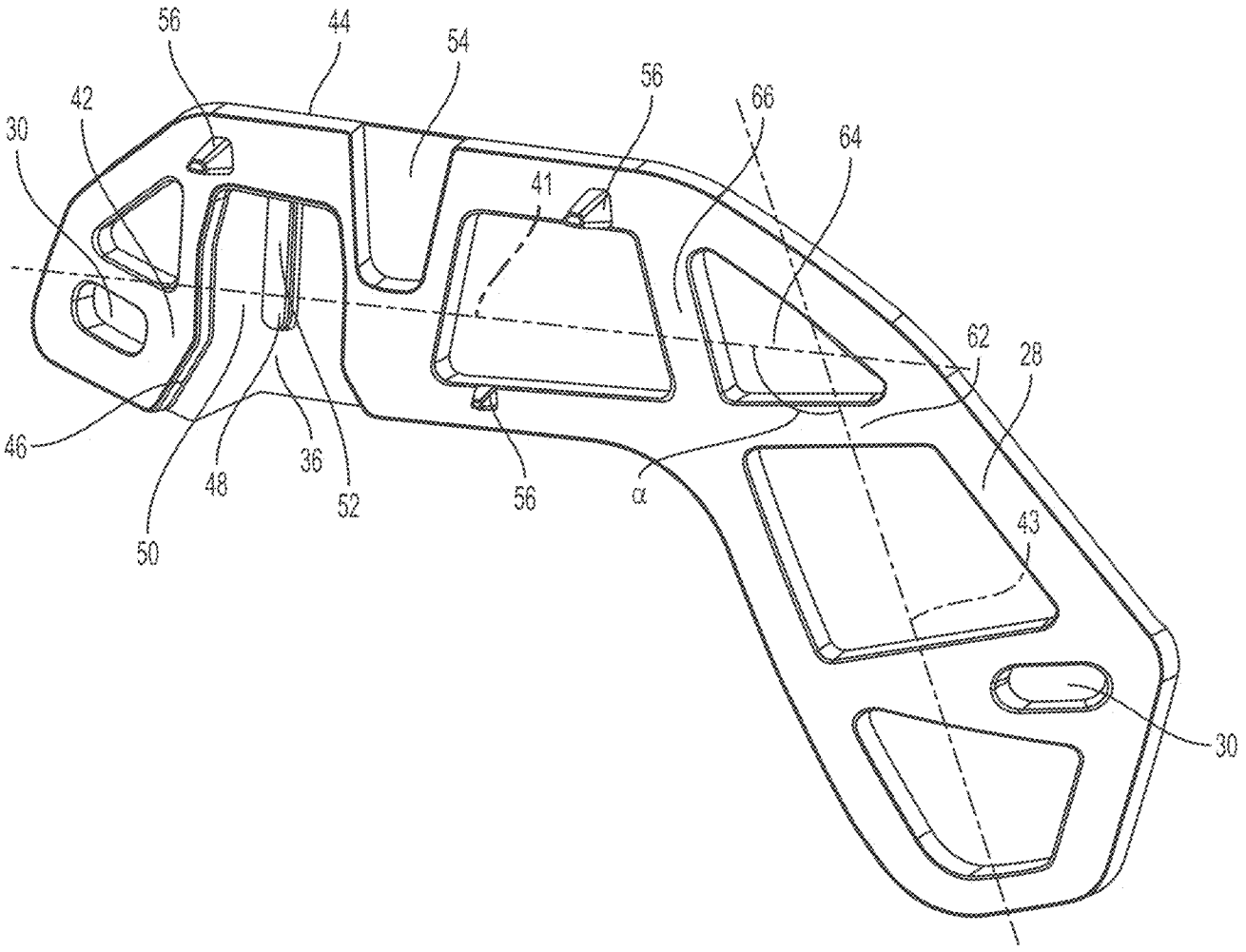
FIG. 4 is an isolated side perspective view of the shim of FIG. 1.

Turning to FIGS. 1, 3, and 4, the mounting rail assembly 20 may include a mounting rail base plate or shim 28 and the rail 22. In use, the shim 28 may be configured to be coupled between the helmet 24 and the rail 22. The rail 22 may include a front surface 25 spaced a first distance from the helmet 24 when the rail 22 is coupled to the helmet 24. The front surface 25 may be spaced a second distance from the helmet 24 when the rail 22 is coupled to the shim 28. The second distance may be greater than the first distance. The rail 22 may include a rear surface opposite the front surface 25.

The shim 28 may be configured to couple to an existing rail 22 to add additional engagement features to the rail 22. In one embodiment, the shim 28 may be selectively detached from the rail 22 to return to directly coupling the rail 22 to the helmet 24. In other embodiments, the shim 28 and the rail 22 are provided or sold together as a kit to allow the user to choose when to install the rail 22 with the shim 28 or when to omit the shim 28. In other embodiments, the shim 28 is fixed to the rail 22 such as through one way snap fit features and or adhesive not intended to be detached, or the shim 28 may be molded with the rail 22 or welded to the rail 22 such that the mounting rail assembly 20 is a unitary construct.

In some embodiments, the shim 28 and the rail 22 have a substantially similar, or identical, footprint. In some embodiments, the shim 28 has an outer perimeter generally shaped to match a footprint of the rail. In other embodiments, the shim 28 has a smaller footprint than the rail 22. In still other embodiments, the shim 28 has a larger footprint than the rail 22. The shim 28 may prevent the rail 22 from contacting the helmet 24 when the rail 22 is coupled to the shim 28 and allow for additional and improved device coupling to the rail as discussed in further detail below.

Referring to FIGS. 1 and 3, the shim 28 may be sandwiched between the rail 22 and the helmet 24. To aid in keeping the shim 28 aligned with the rail 22, the shim 28 may include an aperture 30 configured to receive a fastener (not shown) extending from or through the helmet 24. The fastener may be a threaded bolt, snap, or expanding anchor. The aperture 30 of the shim 28 may be configured to align with pre-existing rail apertures 32 and helmet apertures 34 and be coupled to the helmet 24 using the chin strap bolts or similar fastener. Each of the shim aperture 30 and the rail aperture 32 may be aligned with helmet apertures 34 in the helmet 24. A single fastener may extend through each of the shim aperture 30 and the rail aperture 32 to secure the shim 28 and the rail 22 to the helmet. In one embodiment, the existing chin strap bolts may be used in connection with the shim 28. In other embodiments, longer chin strap bolts are provided for use with the shim 28. In other embodiments, the shim 28 may be attached to the helmet without an aperture such as by an adhesive, heat stake or weld and/or by being sandwiched between the rail 22 and the helmet 24.

The mounting rail assembly 20 may include a recess 36 configured to receive a fastener 40 of a device to couple the accessory device to the mounting rail assembly 20. The recess may be open upwardly (when positioned along a top edge of the mounting rail assembly 20) or downwardly (when positioned along a bottom edge of the mounting rail assembly 20) to receive an accessory device when the shim 28 is coupled between the rail 22 and the helmet 24. The recess 36 may be open generally perpendicular to the mounting groove 29. The recess 36 may provide an additional connection such that one accessory device can be coupled to the mounting groove 29 and a second accessory device can be coupled to the recess 36. The recess 36 may be open in a different direction than the mounting groove 29 such that accessory devices can be coupled to the mounting rail assembly 20 at different angles. The recess 36 may be closer to a top of the helmet than the mounting groove 29. The mounting rail assembly 20 may include multiple recesses 36. The recess 36 may be positioned such that the recess 36 avoids interference with the mounting groove 29 (e.g., an accessory device coupled to recess 36 may be clear of the mounting groove 29). The recess 36 may be proximate an edge of the mounting rail assembly 20. Referring to FIGS. 1, 3, and 4, the shim 28 may include the recess 36 (see FIG. 4). The fastener 40 may be a mount, a projection, a hook, a buckle, a clasp, a clip, or an attachment. The recess 36 may be configured to receive a first portion 38 of the fastener 40.

At least a portion of the recess 36 may be positioned between the front surface 25 or the mounting groove 29 and the rear surface of the mounting rail assembly 20. The recess 36 may be a portion of the shim 28 having a reduced thickness compared to an adjacent portion of the shim 28. The recess 36 may extend from a first side 42 of the shim 28 toward a second side 44 of the shim 28. The first side 42 and second side 44 may be opposing sides of the shim 28. The second side 44 may be adjacent an exterior surface of the helmet 24 when the shim 28 is coupled to the helmet 24. The recess 36 may be open on the first side 42 of the shim 28 which faces a rear side of the rail 22. The recess 36 may be formed by an indent in a front surface of the shim 28 and the rear surface of the rail 22. The recess 36 may open outwardly and be configured to be closed off by the rear surface of the rail 22. In some embodiments, by having the rail 22 close the open side of the recess 36, the thickness of the shim 28 may be reduced. In other embodiments, the recess 36 may be closed on the first side 42 and the second side 44 of the shim 28 and not reliant on the rail 22 or the helmet 24 to close the recess 36. The recess 36 may extend from the second surface 44 toward the first surface 42 such that the fastener 40 is positioned between the helmet 24 and the shim 28 when the fastener 40 is in the recess 36. The recess 36 may extend through the shim 28 from the first side 42 to the second side 44.

The recess 36 may be defined by a sidewall 46. The recess 36 may include a protrusion 48. The protrusion 48 may extend from a surface 50 of the recess 36 toward the first side 42 of the shim 28. The protrusion 48 may extend from the sidewall 46 into the recess 36. An outer surface 52 of the protrusion 48 may be coplanar with the first side 42 of the shim 28. In other embodiments, the outer surface 52 of the protrusion 48 may be recessed compared to the first side 42 of the shim 28.

Figure 6:
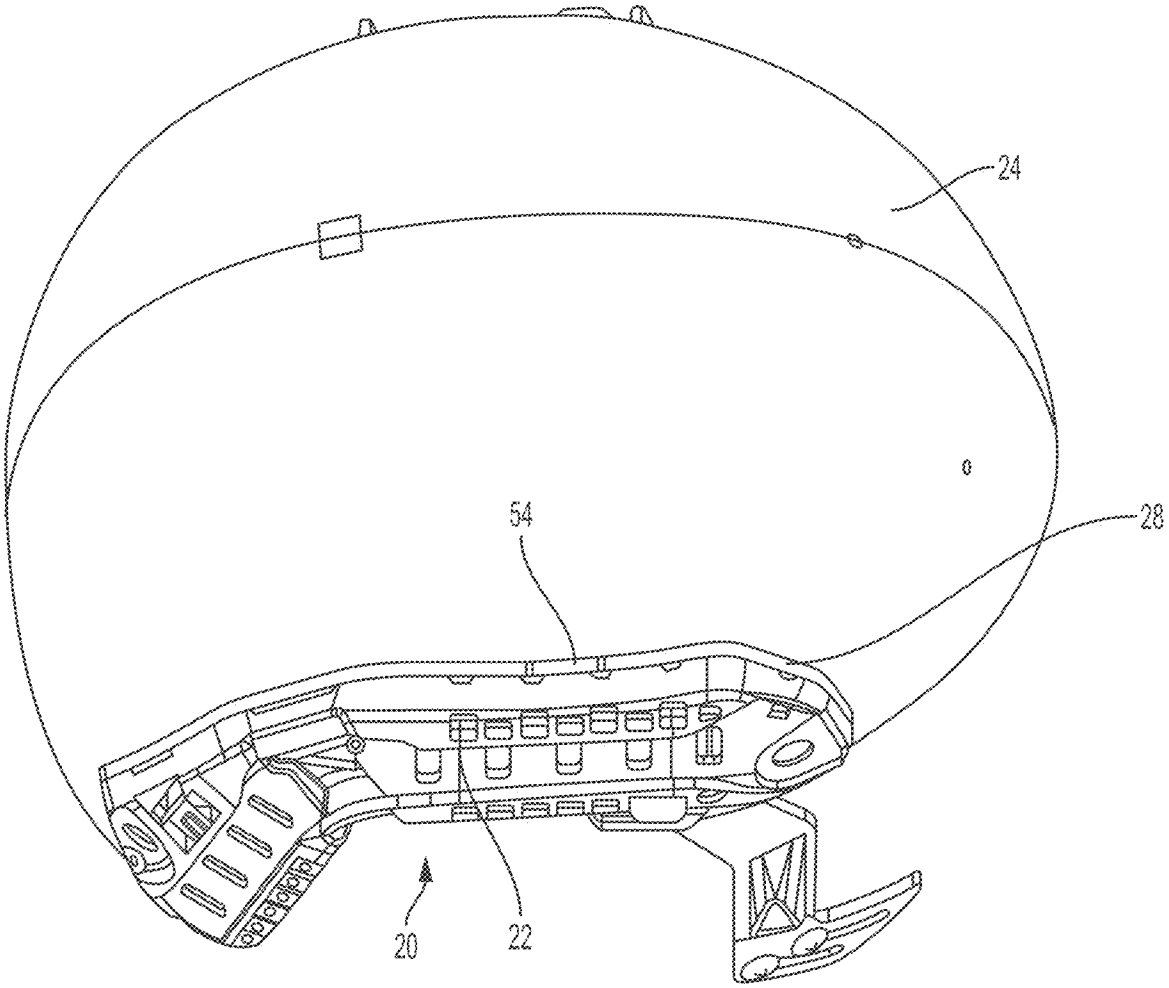
FIG. 6 is a top perspective view of the mounting rail assembly of FIG. 1.
Figure 10:
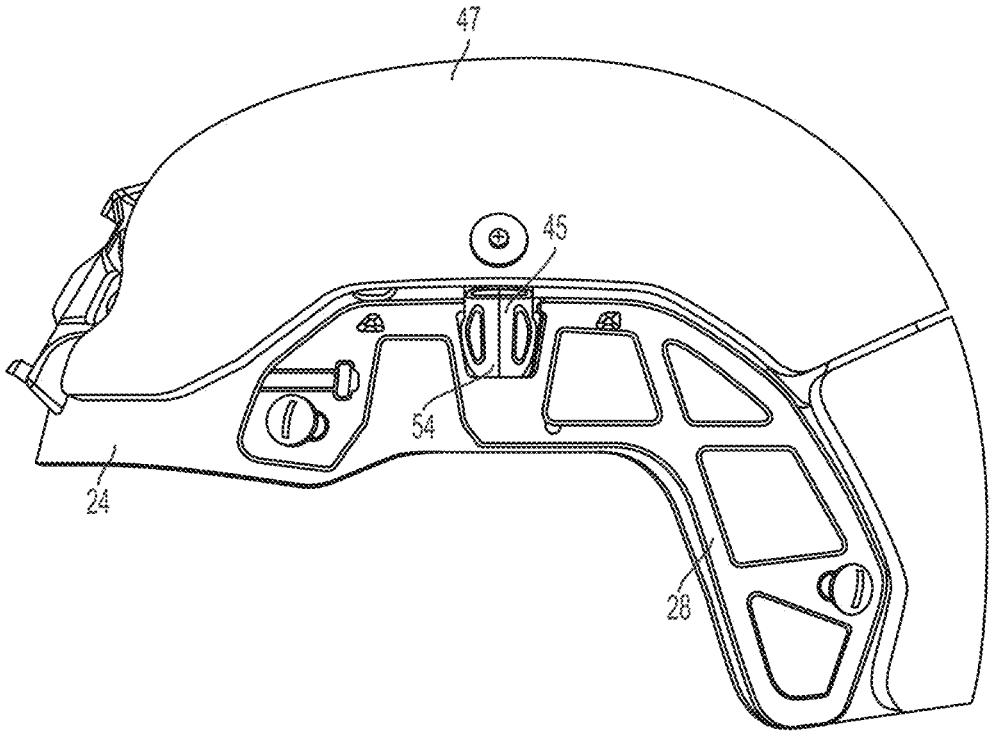
FIG. 10 is a side elevational view of the mounting rail assembly of FIG. 1 with the outer rail removed and a ballistic applique coupled to the mounting rail assembly.

Referring to FIGS. 4, 6, and 10, the mounting rail assembly 20 may include a second recess 54 configured to receive an additional accessory device. The second recess 54 may be proximate an edge of the mounting rail assembly 20. The second recess 54 may be open generally in an opposite direction of the recess 36. In one embodiment, the additional accessory device includes a fastener 45 similar to the fastener 40. In other embodiments, the accessory device may include a first piece configured to be positioned in the second recess and a second piece that could wrap around the top of the rail and clip into the indent 23 or to the rail. The second recess 54 may be a portion of the shim 28 having a reduced thickness compared to an adjacent portion of the shim 28. The second recess 54 may extend from one of the first side 42 and the second side 44 of the shim 28 toward the other of the first side 42 and the second side 44. The second recess 54 may extend through the shim 28 from the first side 42 to the second side 44. The mounting rail assembly 20 or shim 28 may include more than one recess 36 or second recess 54. The second recess 54 may be formed by an indent on the front surface of the shim 28 and the rear surface of the rail 22. The fastener 45 may be coupled to a second accessory device 47 (FIG. 10). The second accessory device 47 may be, for example but not limited to, a ballistic panel or applique, a visor, a goggle, a communication system, a retention system, a light, a camera, a helmet cover, a battery, a gas supply mask, a cable, or a cord. The fastener 45 may help to align the second accessory device 47 on the helmet 22 which may assist a user in attaching and properly aligning the second accessory device 47 on the helmet 22 when the user cannot visually observe the placement of the second accessory device 47 (e.g., when the user is wearing the helmet 22 and attaching the second accessory device 47). In one embodiment, the fastener 45 includes a clip for securing an electrical cord extending to a device mounted on the front of the helmet along the top of the rail 22 and to a battery source mounted on the rear of the helmet. In some embodiments, the rail 22 includes at least one of the second recess 54 and the recess 36 such that the rail receives the fastener 45 or the connector. The second recess 54 or recess 36 may be positioned anywhere along the rail 22 or the shim 28. In some embodiments, a first accessory device can be coupled to the mounting groove 29, a second accessory device can be coupled to recess 36, and a third accessory device can be coupled to recess 54. The first accessory device, second accessory device, and third accessory device may all be coupled to the mounting rail assembly 20 simultaneously while the mounting rail assembly 20 is in use. Recess 36 and recess 54 may be sized and configured to form gaps which allow fastener 40 and/or fastener 45 to be at least partially inserted between helmet 24 and rail 22 and/or between shim 28 and rail 22.

Figure 5:
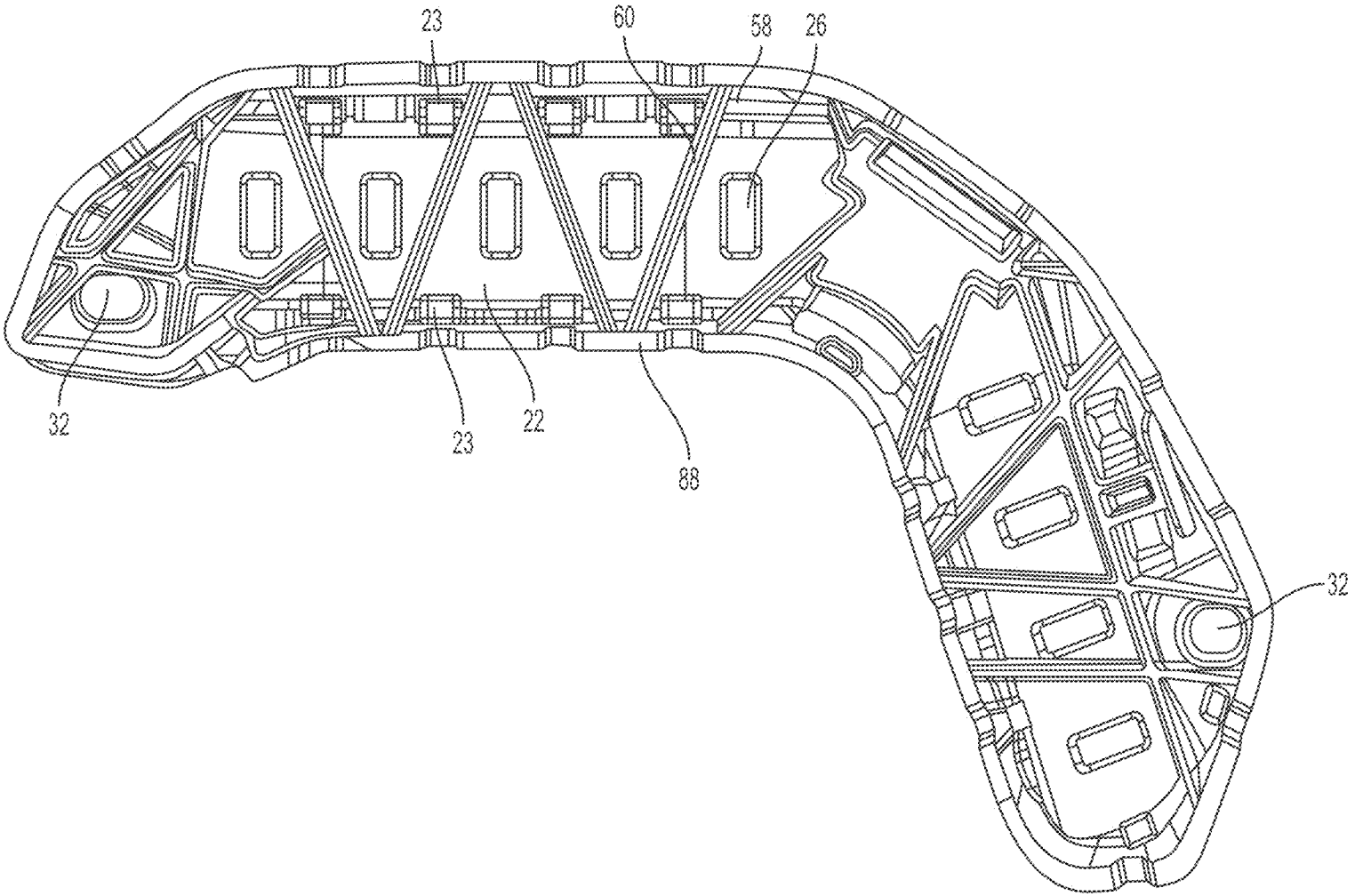
FIG. 5 is an isolated rear elevational view of the rail of FIG. 1.

Referring to FIGS. 4 and 5, the shim 28 may include one or more locating features 56 configured to align the rail 22 on the shim 28. The alignment feature 56 may be a protrusion such as a peg or dowel on one of the rail 22 and the shim 28 configured to engage a recess in the other of the rail 22 and the shim 28. In one embodiment, the alignment feature 56 is a projection that extends away from the first surface 42 of the shim 28. The alignment feature 56 may taper toward a point as the alignment feature 56 extends away from the first surface 42 of the shim. The alignment feature 56 may be configured to be received in a recess 58 in the rail 22. The alignment feature 56 may be configured to be positioned adjacent an existing rail strut 60. The alignment features 56 may have differing sizes and/or shapes. The alignment feature 56 may at least temporarily align the rail 22 on the shim 28 until the rail 22 and the shim 28 are fixed to the helmet. The alignment feature 56 may also help to prevent the rail 22 from sliding relative to the shim 28. In one embodiment, the shim 28 includes at least two alignment features to help prevent rotating of the rail 22 relative to the shim 28. In one embodiment, the shim 28 includes three alignment features 56 spaced apart in a triangular formation. In some embodiments, the rail 22 includes the alignment feature 56 and the shim 28 includes a corresponding feature to receive the alignment feature 56.

The shim 28 may include a body 62 with a plurality of openings 64 extending through the body 62. The openings 64 may reduce the weight of the shim 28 compared to a shim without the weight reducing openings. The body 62 may include struts 66 coupled to a perimeter of the body 62. The interior and exterior surfaces of the shim 28 may have a radius of curvature configured to approximate the radius of curvature of an exterior surface of the helmet 24. In one embodiment, the shim 28 includes a radius, before the shim is coupled to the helmet 24, of about 2 inches to about 12 inches, about 4 inches to about 10 inches, or about 6 inches to about 8 inches. The shim 28 may be manufactured from a flexible material such that the shim 28 may flex to conform to the exterior surface of the helmet 24. In one embodiment, the shim 28 has a radius of curvature less than the radius of curvature of the helmet but is configured to flex to conform to the exterior surface of the helmet 24. The shim 28 may include a first portion having a first axis 41 and a second portion having a second axis 43. The first axis 41 and the second axis 43 may be a median of the first portion and second portion, respectively. The first axis 41 may be transverse to the second axis 43. The first axis 41 may be perpendicular to the second axis 43. An angle $\alpha$ between the first axis 41 and the second axis 43 may be about 60 degrees to about 120 degrees, about 70 degrees to about 110 degrees, about 80 degrees to about 100 degrees, about 70 degrees, about 80 degrees, about 90 degrees, about 100 degrees, about 110 degrees, about 120 degrees, about 130 degrees, about 140 degrees, or about 180 degrees.

The shim 28 may be manufactured from carbon fiber. In other embodiments, the shim 28 may be manufactured from plastic such as ABS (acrylonitrile butadiene styrene), nylon, or polycarbonate. The shim 28 may be comprised of a material and/or include a surface roughness configured to increase the friction between the helmet and the rail 22. In still other embodiments, the shim 28 may be manufactured from carbon fiber or sheet metal (e.g., aluminum, steel, or titanium). The shim 28 may include a thickness between the first side 42 and the second side 44 of the shim 28. The thickness may be selected such that the recess 36 may accommodate the fastener 40 and/or the second recess 54 can accommodate the connector. In one embodiment, the shim 28 and the rail 22 have the same thickness. In another embodiment, the shim 28 is thicker than the rail 22. The shim 28 may have a thickness of about 1 millimeter to about 8 millimeters, about 3 millimeters to about 6 millimeters, or about 4 millimeters.

Figure 2:
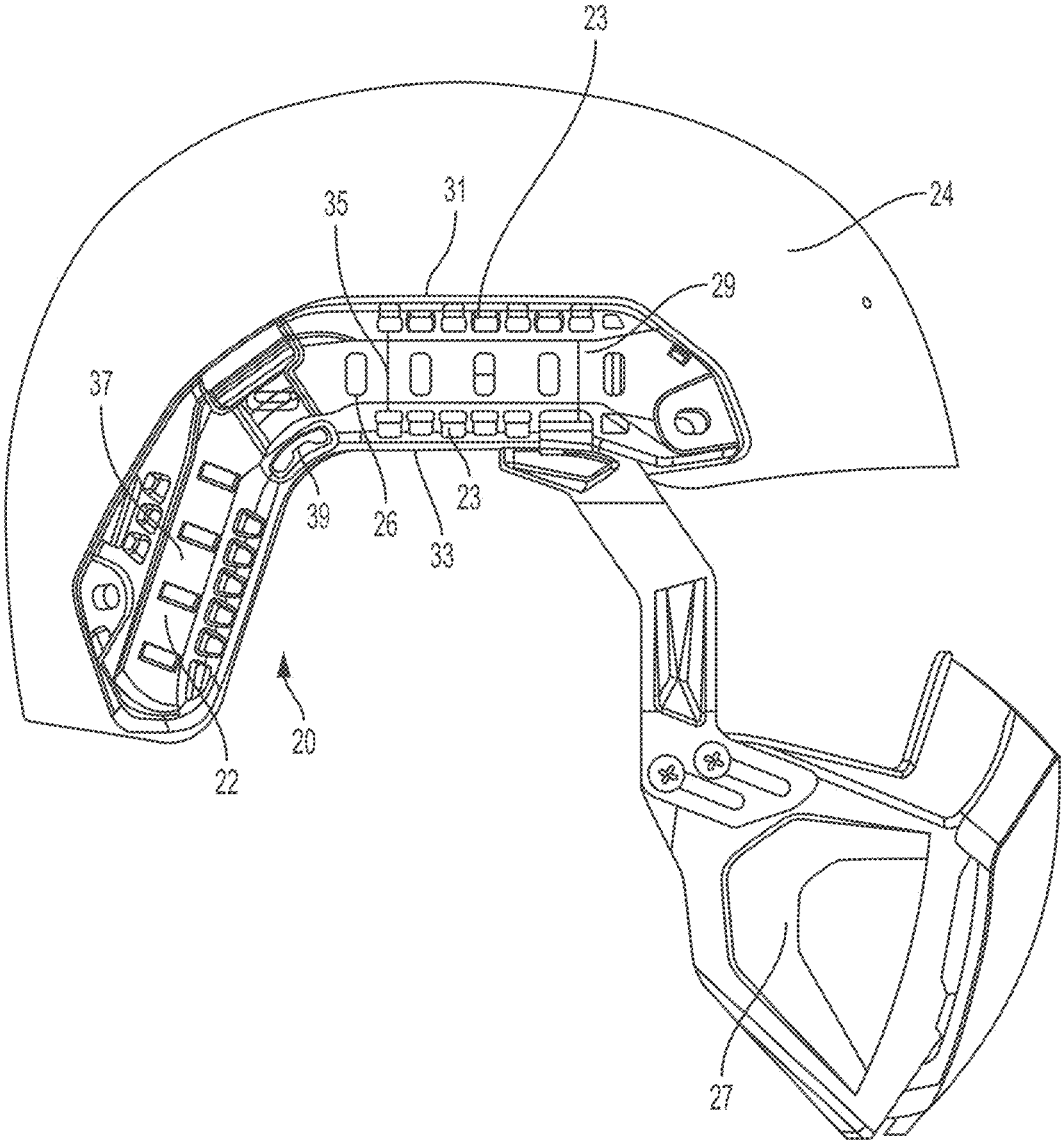
FIG. 2 is a right side elevational view of the mounting rail assembly of FIG. 1.

Referring to FIGS. 2 and 3, the rail 22 may extend between existing bolt holes or helmet apertures 34 (helmet apertures 34 best seen in FIG. 3). The rail 22 may be bent such that the rail follows a contour of the helmet 24. The rail 22 may include a first portion 35 and a second portion 37. The first portion 35 may be transverse to the second portion 37. The rail may include a connector 39 between the first portion 35 and the second portion 37. The connector 39 may be configured to couple to an accessory device (not shown). The connector 39 may be a buckle, clasp, or hook. The rail 28 may extend along an edge (e.g., a lower edge) of the helmet 24. The rail 22 may include a top edge 31 and a lower edge 33. The lower edge 33 may extend along a lower edge of the helmet 24. The rail 22 may include a mounting groove 29 between the top edge 31 and the lower edge 33 of the rail 22. The mounting groove 29 may be configured to receive a connector coupled to an accessory device (not shown). The mounting groove 29 may be open such that the connector coupled to an accessory device can slide along the length of the mounting groove 29 and be coupled to the accessory device at two or more positions along the length of the rail 22. At least one of the top edge 31 and the lower edge 33 may be parallel with the mounting groove 29. The recess 36 may be along the top edge 31 or lower edge 33 edge. The recess 36 may be positioned somewhere along the length of the mounting groove 29. The recess 36 may be open in a direction generally perpendicular to the opening of mounting groove 29.

Figure 7:
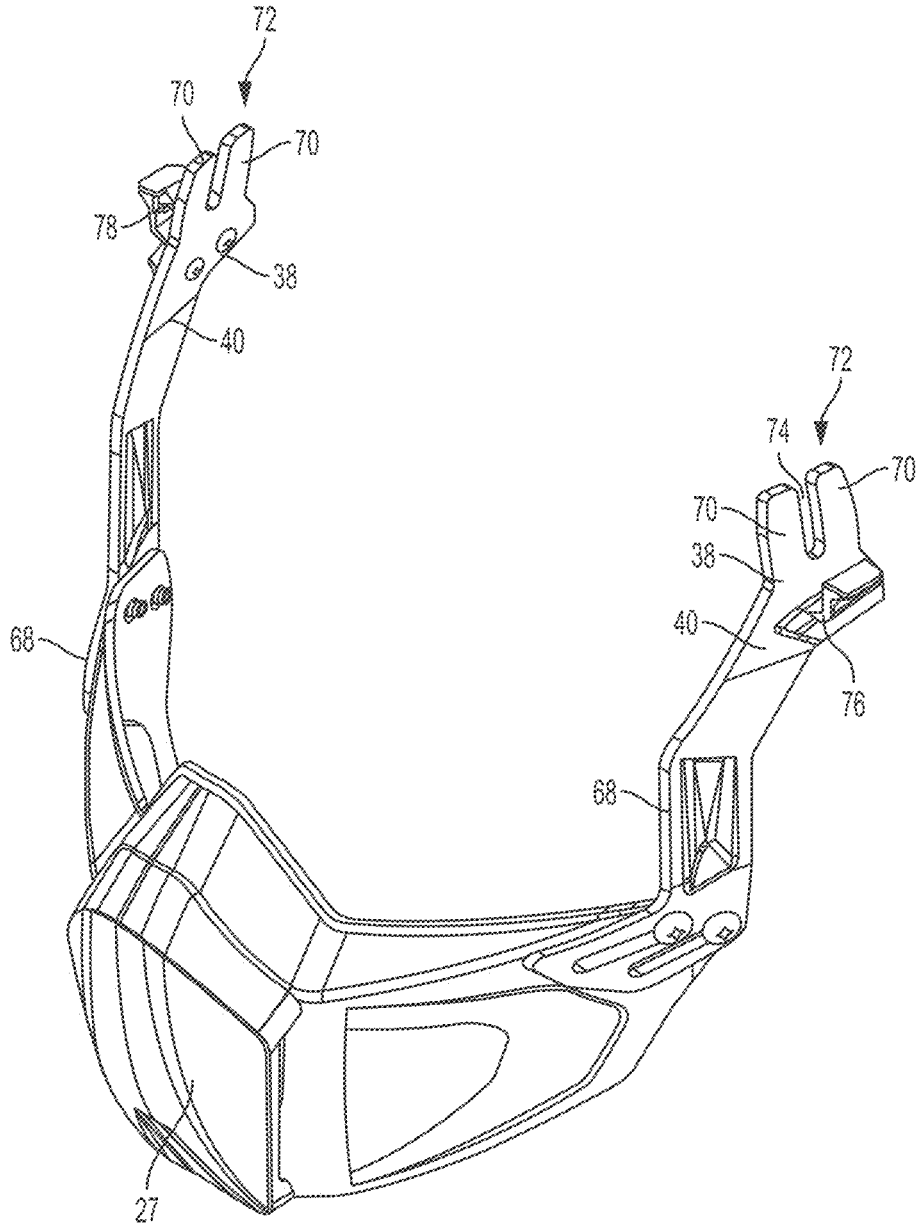
FIG. 7 is a front, side perspective view of the mandible shield shown in FIG. 1.
Figure 8:
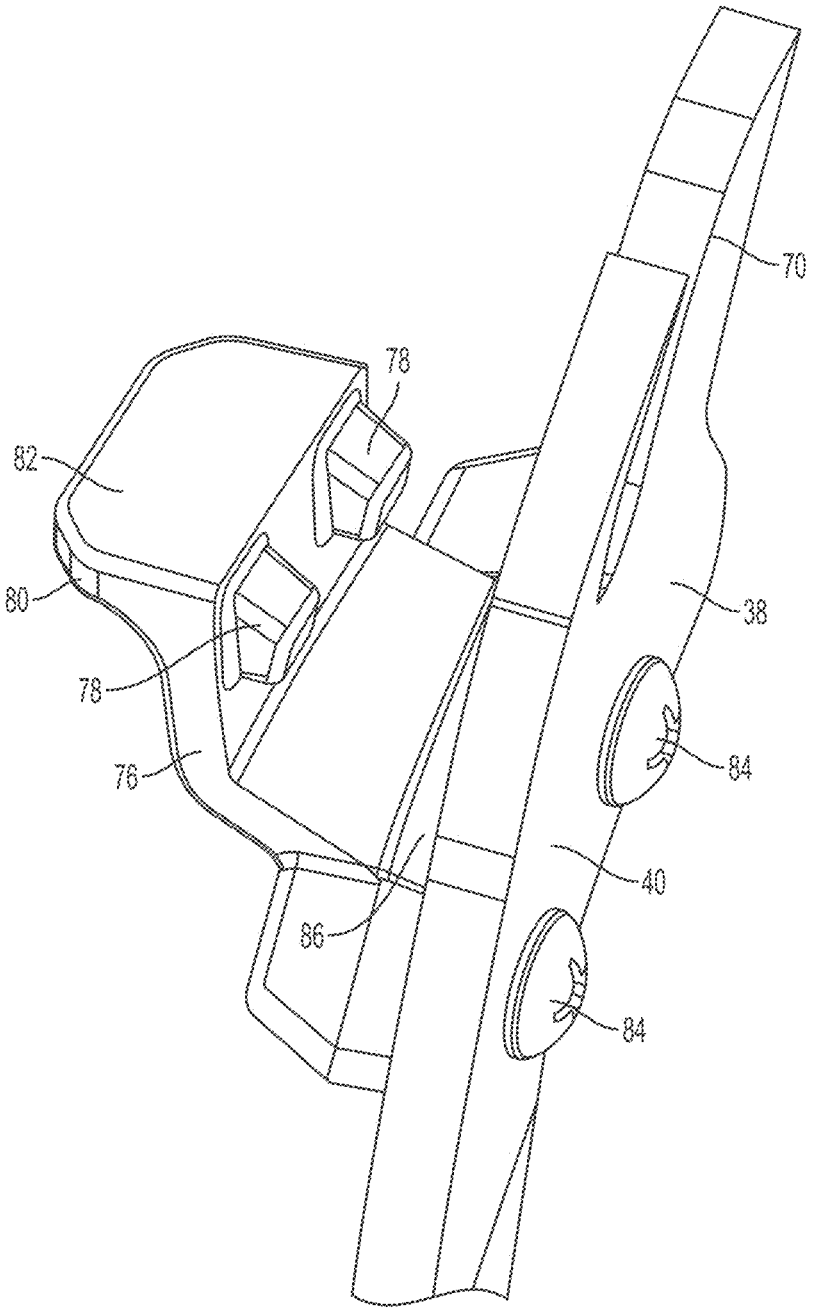
FIG. 8 is a close-up front perspective view of the fastener of the mandible shield shown in FIG. 1.

Referring to FIGS. 3, 7, and 8, the fastener 40 may include a second portion 68 coupled to the device 27. The device 27 may be a mandible shield (such as the one shown), a mask, a visor, a goggle, a communication system, a retention system, a light, a camera, a helmet cover, a battery, a cable, or a cord. A first device may be coupled to the second portion 68 of the fastener. A second device may be coupled to the mounting groove 29. A third device may be coupled to the second recess 54.

In one embodiment, the recess 36 allows for a first device to be attached to the rail 22 and for a second device to be coupled anywhere along the mounting groove 29. The first portion 38 of the fastener 40 may include a prong 70 configured to be received by the recess 36. The prong 70 may couple the first portion 38 of the fastener 40 to the shim 28 when the prong 70 is positioned within the recess 36. The prong 70 may be one of a plurality of prongs 72. The plurality of prongs 72 may be separated by a space 74. The space 74 may be configured to receive the protrusion 48 when the plurality of prongs 72 are within the recess 36. The space 74 may be wider than the protrusion 48 such that the plurality of prongs 72 maintain their alignment when the first portion 38 of the fastener 40 is positioned within the recess 36. In other embodiments, the space 74 may be narrower than the protrusion 48 such that the plurality of prongs 72 are deflected away from each other, or the protrusion 48 is compressed, when the protrusion 48 is within the space 74. The shim 28 may include more than one recess 36 such that the shim 28 can be coupled to more than one fastener 40. In still other embodiments, the prongs 70 may form snap fit features such as a buckle.

With continued reference to FIGS. 3 and 7-8, the fastener 40 may include an attachment arm 76 configured to engage a feature such as a recess or indent 23 of the rail 22. The attachment arm 76 may couple the fastener 40 to the rail 22 when the attachment arm 76 is engaged with the indent 23. The attachment arm 76 may be flexible to move between an engaged position and a disengaged position. The attachment arm 76 may include a protrusion such as a peg 78 configured to engage the indent 23 on the rail 22 when the attachment arm 76 is in the engaged position (peg 78 best seen in FIG. 8). The peg 78 may be one of a plurality of pegs configured to engage more than one indent 23. In one embodiment, there are two pegs 78 that are configured to engaged corresponding recesses 23 in the rail. In one embodiment, a plurality of pegs 78 each engaging a different indent 23 may at least partially prevent rotation or twisting of the fastener 40 relative to the rail 22 along a plane generally parallel to the rail. The peg 78 may be disengaged from the indent 23 when the attachment arm 76 is in the disengaged position. The attachment arm 76 may include a toggle 80 configured to be manually engaged to move the attachment arm 76 between the engaged position and the disengaged position. In one embodiment, the toggle 80 is flexible and biased toward the rail when flexed away from the rail. The attachment arm 76 may be biased toward the engaged position such that engaging the toggle 80 moves the attachment arm 76 to the disengaged position. The toggle 80 may include a platform or tab 82 engageable by a user's thumb or finger. In other embodiments, the toggle 80 may be a push-button or lever. The attachment arm 76 may be coupled to the fastener 40 by an anchor 84. In other embodiments, the attachment arm 76 may be coupled to the fastener 40 by adhesive or welding. In still other embodiments, the attachment arm 76 and the fastener 40 may be a unitary construct. The attachment arm 76 may include an inner surface 86 configured to abut a lower surface 88 of the rail 22 when the fastener 40 is coupled to the shim 28 and rail 22.

Figure 9:
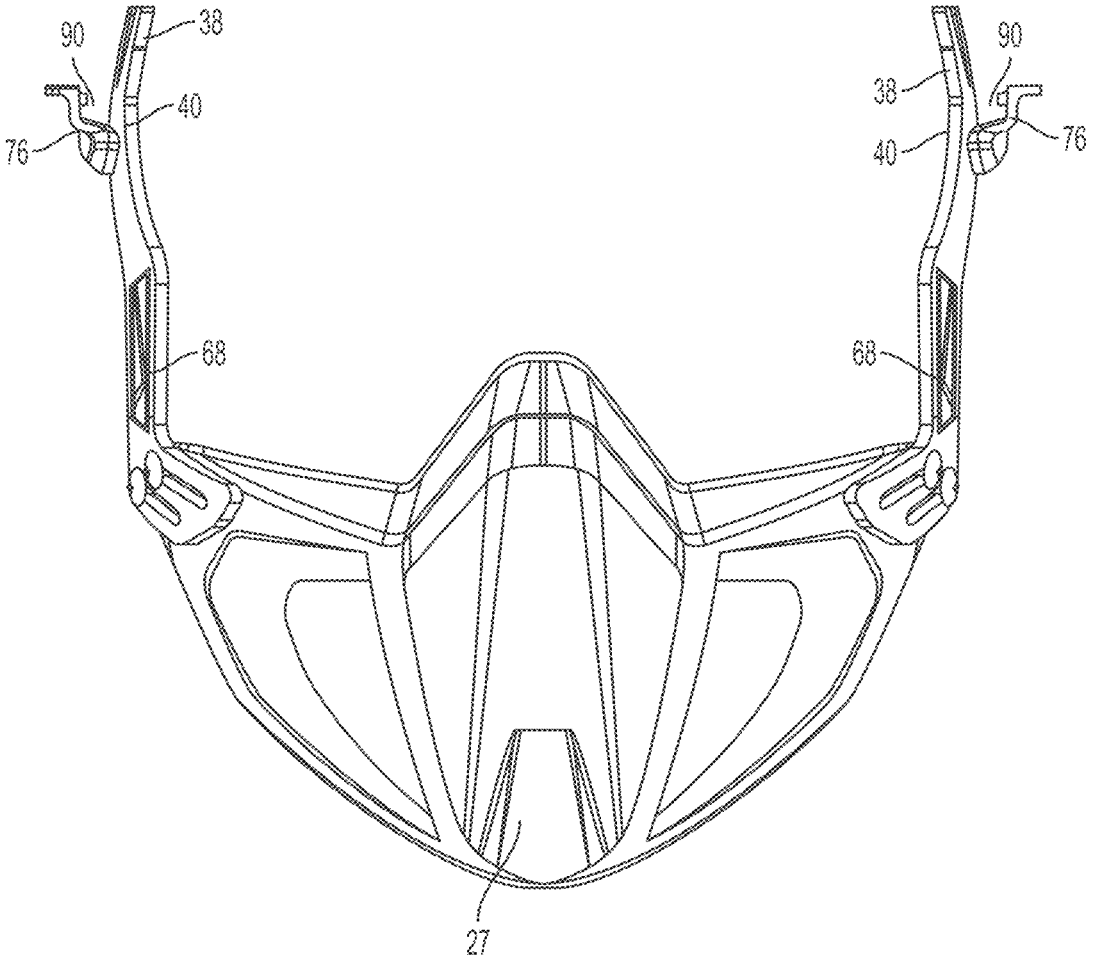
FIG. 9 is a front elevational view of the mandible shield of FIG. 1.

Referring to FIG. 9, the attachment arm 76 and first portion 38 of the fastener 40 may define a channel 90 configured to receive a portion of the rail 22 when the fastener 40 is coupled to the shim 28 and rail 22. A first surface (e.g., the first portion 38) of the fastener 40 may contact an inner surface of the rail 22 and a second surface (e.g., the attachment arm 76) may contact an outer surface of the rail 22 when the fastener 40 is coupled to the rail 22. In one embodiment, the fastener 40 wraps around a top or bottom edge of the rail 22. In one embodiment, the fastener 40 may be connected to the fastener 45 such that the combined fastener 40 and fastener 45 encircle the rail 22 when the fastener 40 is within the recess 36 and the fastener 45 is within the second recess 54. In one embodiment, the coupler (not shown) wraps around a top or bottom edge of the rail 22. The fastener 40 may be engaged and/or disengaged from the shim 28 and/or rail 22 while the shim 28 and rail 22 are coupled to the helmet 24. Thus, the device 27 may be coupled or decoupled from the rail 22 and/or shim 28 while the rail 22 and the shim 28 are coupled to the helmet 24.

The shim 28 may be included in a kit configured to be coupled to existing rail 22 and helmet systems. A method of retrofitting a helmet may include obtaining a shim 28. The method of retrofitting may include detaching the existing rail 22 from the helmet. The method may include aligning the rail 22 with the shim 28 by engaging the alignment feature 56 with the recess 58. The method may include securing the rail 22 and the shim 28 to the helmet 24 with an anchor. The method may include coupling the fastener 40, and thus the device 27, to the rail 22 and/or shim 28.

Figure 11:
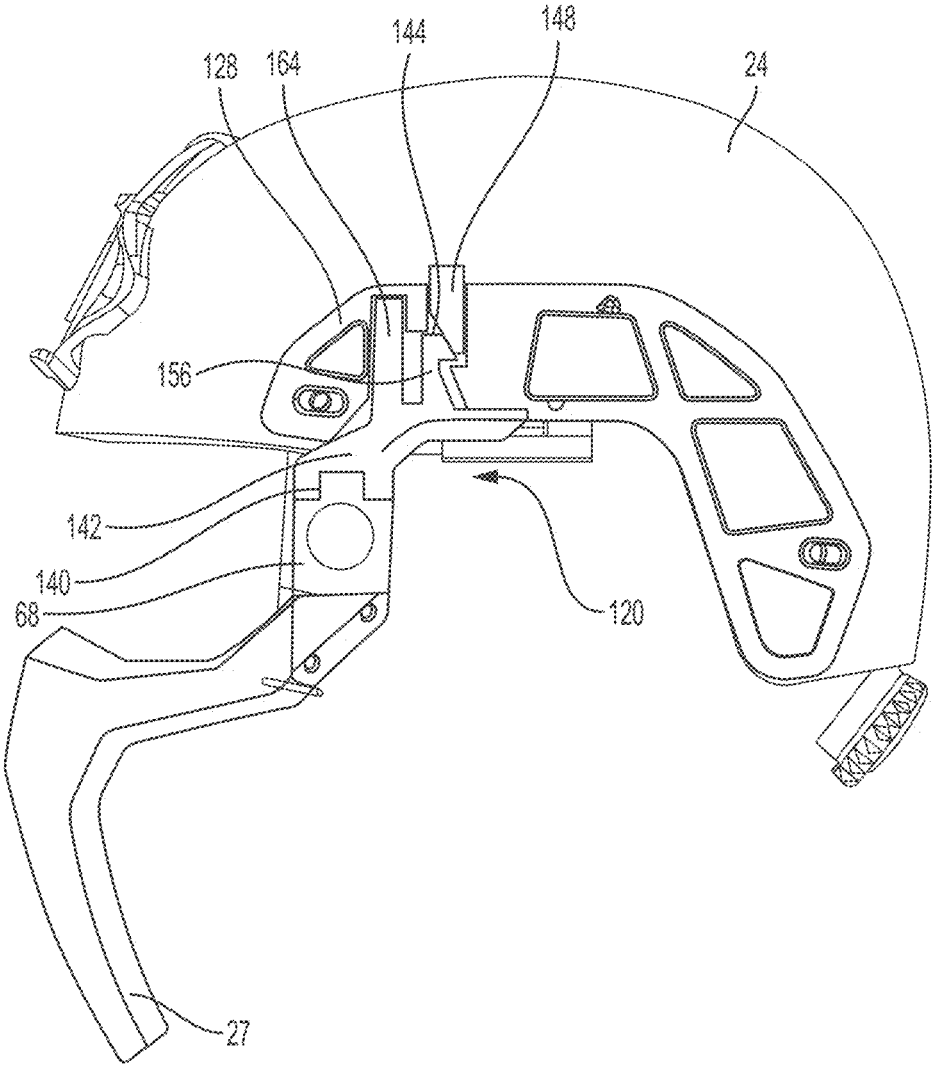
FIG. 11 is a side elevational view of a mounting rail assembly in accordance with a second embodiment of the present invention with the outer rail removed.
Figure 12:
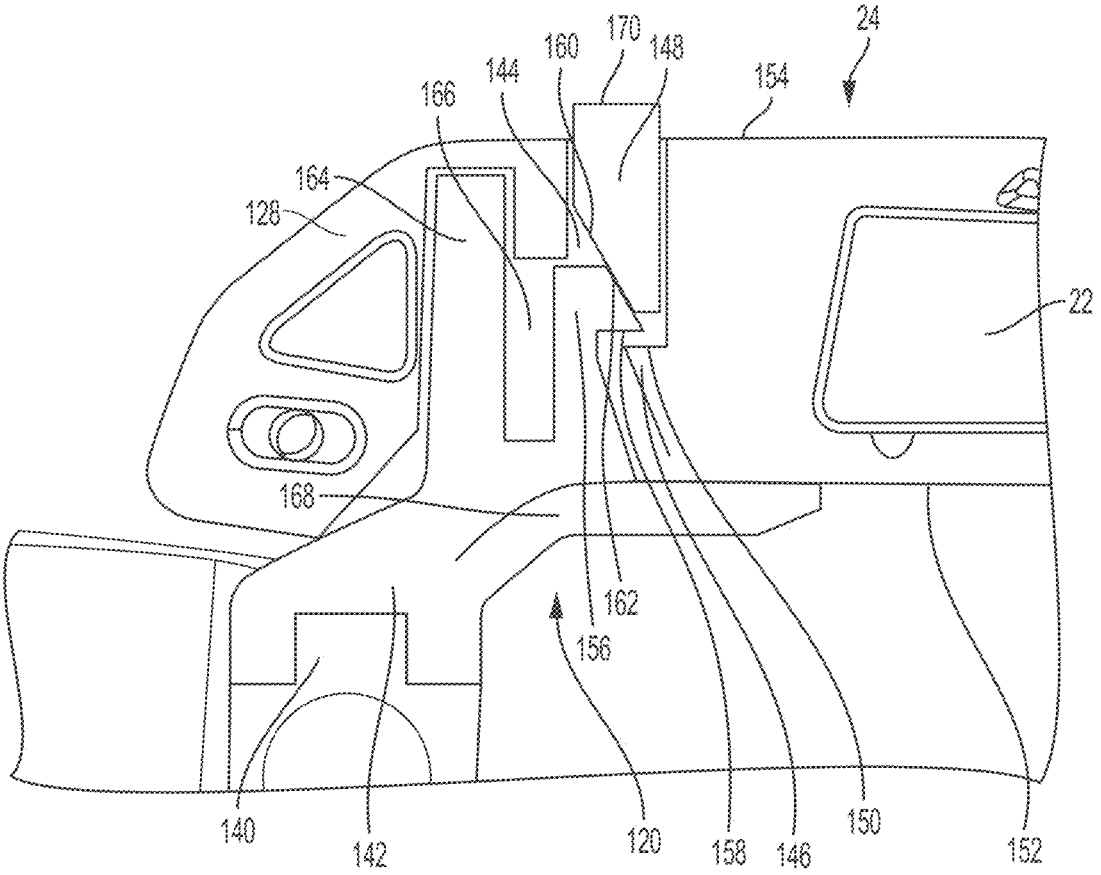
FIG. 12 is a close up side elevational view of the mounting rail assembly of FIG. 11.

Referring to FIGS. 11 and 12, there is shown a second exemplary embodiment of a mounting rail assembly, generally designated 120. The mounting rail assembly 120 is similar to the first embodiment of the mounting rail 20 except the recess of mounting rail assembly 120 may include a locking feature.

Still referring to FIGS. 11 and 12, the mounting rail assembly 120 may include a fastener 140 having a second portion 68 configured to be coupled to a device. The fastener 140 may include a first portion 142 configured to engage a recess 144 in the shim 128. The mounting rail assembly 120 may include a release 148 configured to disengage the fastener 140 from the recess 144.

The recess 144 may include a sidewall 146 configured to be engaged by the fastener 140. The sidewall 146 may include a ledge 150. The ledge 150 may be perpendicular to an adjacent portion of the sidewall 146. In other embodiments the ledge 150 may be oblique to the adjacent portion of the sidewall 146. The first portion 142 of the fastener 140 may include an arm 156 deflectable from an engaged position to a disengaged position. The arm 156 may include a rim 158 configured to engage the ledge 150 when the fastener 140 is within the recess 144. The ledge 150 and the rim 158 may be parallel to each other. At least one of the ledge 150 and the rim 158 may be parallel to one of the first side 152 and the second side 154 of the shim 128.

The release 148 may be selectively engageable by a user and configured to deflect the arm 156 from the engaged position to the disengaged position to disengage the fastener 140 from the sidewall 146. The release 148 may include a release engagement surface 160 configured to engage an arm engagement surface 162. At least one of the release engagement surface 160 and the arm engagement surface 162 may include an angled surface such that relative axial movement between the release engagement surface 160 and the arm engagement surface 162 causes transverse movement of the arm 156. The release 148 may be moveable relative to the shim 128. In one embodiment, the arm engagement surface 162 is obliquely angled relative to an axis along which the release 148 moves relative to the shim 128. In one embodiment, the release 148 may be slideable within the recess 144. In other embodiments, the release 148 may include a cam such that rotation of the release 148 disengages the fastener 140 from the sidewall 146. The release engagement surface 160 may engage the arm engagement surface 162 as the release 148 is moved relative to the shim 128 and disengage the fastener 140 from the sidewall 146. In one embodiment, movement of the release 148 may deflect the arm to the disengaged position, thereby disengaging the rim 158 from the ledge 150 such that the fastener 140 may be removed from the recess 144. The release may be moveably coupled to the shim 128. An end 170 of the release 148 may be positioned above the second side 154 of the shim 128 when the fastener 140 is in the recess 144. In other embodiments, the end 170 of the release 148 may be co-planar or below the second side 154 of the shim 128 when the fastener 140 is in the recess 144. The recess 144 may extend from a first side 152 of the shim 128 to a second side 154 of the shim 128.

The first portion 142 of the fastener 140 may include a brace 164 configured to maintain the position of the fastener 140 in the recess 144 when the release 148 is moved relative to the shim 128. The brace 164 may prevent lateral movement of the fastener 140 when the release 148 engages the arm 156. The brace 164 may assist in aligning the fastener 140 within the recess 144 during insertion of the fastener 140. The recess 144 may include a protrusion 166 configured to be positioned between the arm 156 and the brace 164 when the fastener 140 is within the recess 144. The fastener 140 may include a base 168 configured to abut an edge of the shim 128 and/or rail 22 when the fastener 140 is within the recess 144. The fastener 140 may be between the shim 128 and the rail 22 when the fastener 140 is within the recess 144. The fastener 140 may be between the shim 128 and the helmet 24 when the fastener 140 is within the recess 144.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the mounting rail base plate. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

We claim:

1. A rail for mounting accessories to a helmet, the rail comprising:

a front surface;

a mounting groove extending along a length of the front surface, the mounting groove open outwardly from the front surface of the rail and configured to adjustably couple to a first accessory device at two or more positions along the length of the front surface; and a recess proximate an edge of the rail, the recess open generally perpendicular to the mounting groove and configured to receive a second accessory device, at least a portion of the recess positioned between the mounting groove and a rear surface of the rail.

2. The rail of claim 1 further comprising:

a shim configured to be positioned between the rail and the helmet, the shim forming at least a portion of the recess.

3. The rail of claim 2, wherein the recess is formed by an indent in a front surface of the shim and the rear surface of the rail.

4. The rail of claim 2, wherein the shim is configured to flex to conform to a shape of an exterior surface of the helmet.

5. The rail of claim 1 further comprising:

a fastener having a first portion positioned at least partially within the recess and a second portion configured to be coupled to the second accessory device.

6. The rail of claim 5, wherein the recess includes a protrusion and the fastener includes a plurality of prongs separated by a space, and wherein the protrusion is configured to be positioned within the space when the plurality of prongs are within the recess.

7. The rail of claim 5, wherein:

the rail includes at least one indent below the mounting groove, and the fastener includes an attachment arm configured to engage the at least one indent to further couple the fastener to the rail when the fastener is positioned at least partially within the recess.

8. The rail of claim 7, wherein the attachment arm includes at least one peg configured to engage the at least one indent when the attachment arm is in an engaged position.

9. The rail of claim 5, wherein the recess includes a first recess, the mounting rail assembly further comprising:

a second recess proximate the edge of the rail, open generally in an opposite direction of the first recess, and configured to receive a third accessory device.

10. A rail assembly comprising:

the rail of claim 9; and the third accessory device, the third accessory device including one or more of a ballistic panel or applique, a visor, a goggle, a communication system, a retention system, a light, a camera, a helmet cover, a battery, a gas supply mask, a cable, and a cord.

11. The rail of claim 5, wherein the recess includes a sidewall and the rail includes a release selectively engageable by a user to disengage the fastener from the sidewall.

12. The rail of claim 11, wherein the fastener includes a deflectable arm and the release is configured to deflect the deflectable arm to disengage the fastener from the sidewall.

13. The rail of claim 12, wherein the sidewall includes a ledge and the deflectable arm includes a rim configured to engage the ledge when the fastener is within the recess.

14. The rail of claim 11, wherein the fastener includes a brace configured to maintain the position of the fastener in the recess when the release is moved relative to the shim.

15. A rail assembly comprising:

the rail of claim 1; and the second accessory device, the second accessory device including one or more of a mandible shield, a communication system, a gas supply mask, and a chin strap.

16. The rail of claim 1, wherein the mounting rail assembly is a unitary construct including the shim and the rail.

* * * * *